United States Patent [19]

Haber

[11] 4,246,733

[45] Jan. 27, 1981

[54] PRE-FABRICATED WALL ASSEMBLY

[75] Inventor: Terry M. Haber, Mission Viejo, Calif.

[73] Assignee: William L. Thompson, Mission Viejo, Calif.

[21] Appl. No.: 53,958

[22] Filed: Jul. 2, 1979

[51] Int. Cl.[3] ..... E04B 2/22

[52] U.S. Cl. ..... 52/309.11

[58] Field of Search ..... 52/309.4, 309.11

[56] References Cited

U.S. PATENT DOCUMENTS

| | | | |
|---|---|---|---|
| 3,389,519 | 6/1968 | Williams | 52/309.11 |
| 3,802,141 | 4/1974 | Hayes | 52/309.11 |

*Primary Examiner*—John E. Murtagh

*Attorney, Agent, or Firm*—Ralph B. Pastoriza

[57] ABSTRACT

The pre-fabricated wall assembly comprises essentially a rectangular frame structure provided with first and second panels on opposite sides together with inserts in the form of smaller square-shaped frames of the same depth as the distance between the panels so as to function as reinforcing inserts. Each insert is formed of two long and two short sides, the shorter sides fitting between the ends of the longer sides and being offset so as to provide flow passage therethrough. A polyurethane foam is introduced into the interior of the rectangular frame which foam will flow and fill voids in the inserts as well as all voids between the panels and interior of the frame. The resultant assembly provides a highly heat resistant, soundproof and strong wall assembly for use in construction.

6 Claims, 8 Drawing Figures

PRE-FABRICATED WALL ASSEMBLY

This invention relates generally to construction products and more particularly to an improved pre-fabricated wall assembly for use in residential or commerical building constructions.

BACKGROUND OF THE INVENTION

Conventional pre-fabricated wall assemblies do not in all instances provide the desired strength, soundproofing and fire resistant characteristics desirable in building walls. Further, where the entire wall is prefabricated, it is relatively heavy and difficult to manipulate. The reason for the large weight is the plentiful use of reinforcing studs or the like which are normally positioned between facing panels. These studs extend the entire length of the panels and while serving to prevent buckling of central portions of the panels, add greatly to the overall weight. If soundproofing and fire resistant characteristics are to be provided, it is usually necessary to hand pack appropriate foam or cellulose type material between the various studs prior to the attachment of one of the panels. The operation is relatively time-consuming and thus expensive both from a material and labor standpoint.

BRIEF DESCRIPTION OF THE PRESENT INVENTION

With the foregoing considerations in mind, the present invention contemplates a greatly improved pre-fabricated wall assembly which is not only considerably less expensive and easier to fabricate than known prefabricated walls but in addition is lighter and is both soundproof and fire resistant. While the assembly of this invention is referred to as a prefabricated wall assembly, this terminology is meant to include assembly structures which might be used as overhead beams in doorways or large openings or even in ceiling structures. The term "wall" as used herein is thus meant to be generic to such other applications.

Briefly, in accord with the present invention, the assembly includes a first rectangular panel member arranged to be secured to one side of a rectangular frame of given length, width and depth dimensions. At least one reinforcing insert of depth equal to the referred to given depth is positioned within the rectangular frame and a second panel member then secured to the opposite side of the frame, the reinforcing insert engaging the opposed inner walls of the first and second panels. Thus, rather than continuously extending stud type reinforcements between the first and second panels, there is rather provided the reinforcing insert which is substantially of less bulk and yet provides the necessary reinforcement in combination with other components.

With the assembly as described above, a foam material is injected into the rectangular frame between the opposing walls of the panel, the foam filling all of the voids in the frame as well as the voids in the insert. When the foam has set, a prefabricated wall assembly results which has strength characteristics improved over presently available panels of equivalent size and yet the entire panel structure is substantially lighter, is relatively soundproof and relatively fire resistant.

BRIEF DESCRIPTION OF THE DRAWINGS

A better understanding of this invention will be had by now referring to the accompanying drawings in which.

DETAILED DESCRIPTION OF THE INVENTION

Figure 1:
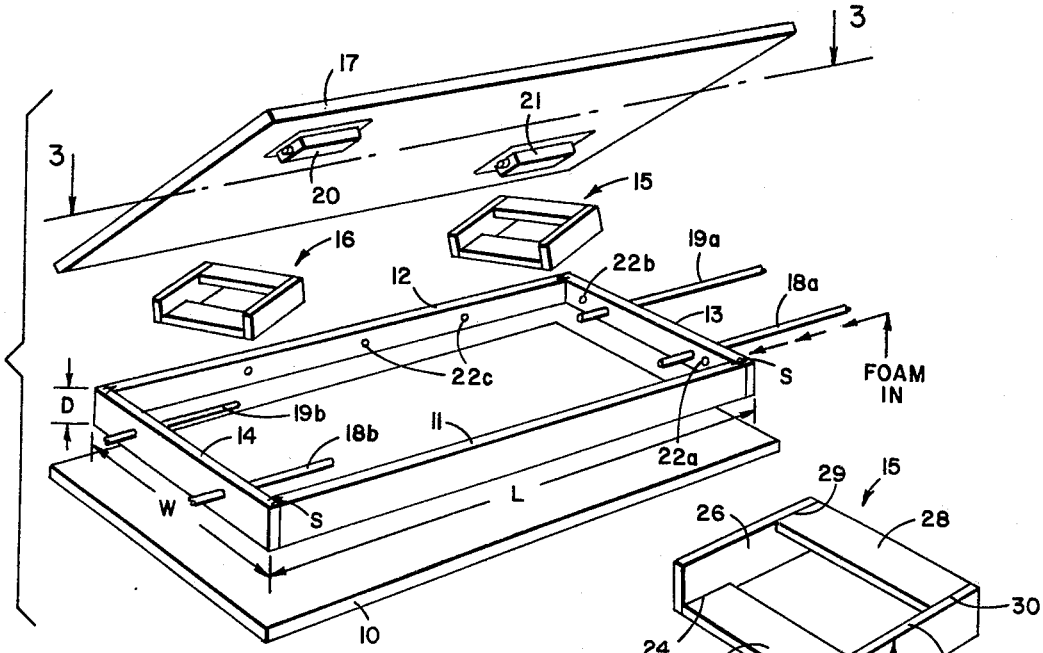
FIG. 1 is an exploded perspective view of a prefabricated wall assembly in accord with the present invention.

Referring first to FIG. 1, the wall assembly includes a first rectangular panel member 10. A rectangular frame comprised of longer sides 11 and 12 and shorter sides 13 and 14, secured together by truss staples S, has overall length L, width W and depth D given dimensions. Panel member 10 is arranged to be secured to one side, such as the bottom side of the frame as oriented in FIG. 1, with the margins of the panel 10 overlapping slightly the dimensions of the rectangular frame.

At least one and preferably two reinforcing inserts 15 and 16 of depth equal to the given depth D of the frame are provided and shown in exploded view in FIG. 1. Each of these inserts is identical and will be described in detail subsequently.

A second rectangular panel 17 of the same overall dimensions as the panel 10 is secured to the opposite or upper side of the frame as viewed in FIG. 1.

In the particular embodiment illustrated, utility conduits **18*a* and 19*a* may be provided extending through the shorter side 13 for connection to appropriate preassembled utility boxes 20 and 21 secured to panel 17, the conduits continuing from the other side of the boxes as shown at 18*b* and 19*b* to pass through the other shorter side 14**.

Also shown in FIG. 1 is a foam tube opening **22*a* communicating with the interior of the rectangular frame, this entrance opening being located adjacent to one of the corners of the frame. A primary exit opening indicated at 22*b* is also provided adjacent to another corner of the frame, this exit opening also communicating with the interior of the rectangular frame. Secondary exit openings 22*c* are also provided in the frame member 12** indicated.

Figure 2:
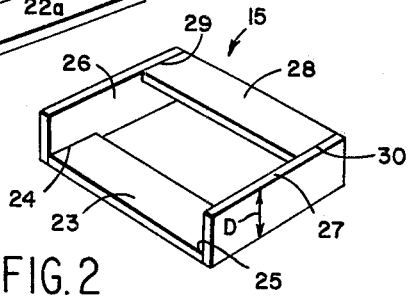
FIG. 2 is an enlarged perspective view of one of the reinforcing inserts utilized in the construction of FIG. 1.

Referring now to FIG. 2, there is illustrated in greater detail the reinforcing insert 15. This structure includes a relatively short wooden member 23 disposed between end portions 24 and 25 of two parallel longer wood sides 26 and 27. A second short piece of wood 28 in turn extends between the other ends 29 and 30 of the long sides 26 and 27 respectively. The overall structure constitutes substantially a smaller frame which is approximately square. It will be noted that the shorter member 23 extends between the lower end portions of the longer members 26 and 27 while the member 28 extends between the upper end portions of these members there thus being defined a through passage when the insert is received between the opposite walls of the panels 10 and 11 in FIG. 1; that is, there is a through passage over the shorter member 23 and under the shorter member 28 between the long sides 26 and 27.

Figure 3:
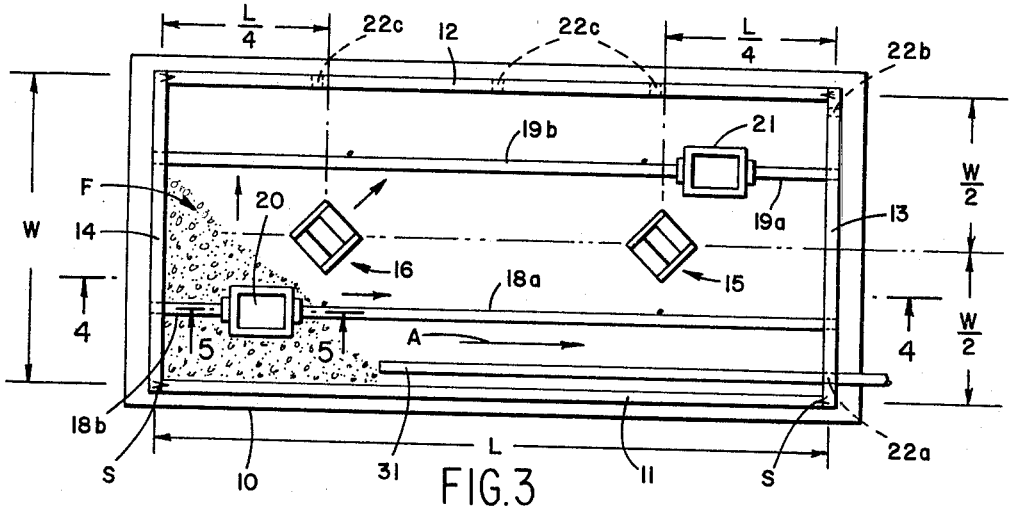
FIG. 3 is a plan cross section of the assembled wall of FIG. 1.

Referring to the plan view of FIG. 3 showing the assembly with the top panel 17 removed, it will be noted that each of the inserts 15 and 16 are disposed approximately midway between the longer sides 11 and 12 of the frame and about one fourth the overall length L from the shorter ends of the frame. Further, each of the inserts is disposed so that its through passage forms an angle of 45° with the longer sides 11 and 12 of the frame.

With the foregoing arrangement, and with the top panel 17 in position, foam injected by foam tube 31 passes through the entrance opening 22*a* to the far interior corner of the rectangular frame. Tube 31 is gradually withdrawn to the right in the direction of the arrow A as viewed in FIG. 3 as foam F is ejected. The foam F fills the interior flowing in the direction of the arrows to pass through openings of the angulated reinforcing inserts 15 and 16 and readily flows to fill completely the interior of the rectangular frame and voids in the inserts themselves. Air escapes through the exit opening 22*b* at the diagonally opposite corner and through the secondary openings 22*c*.

Figure 4:
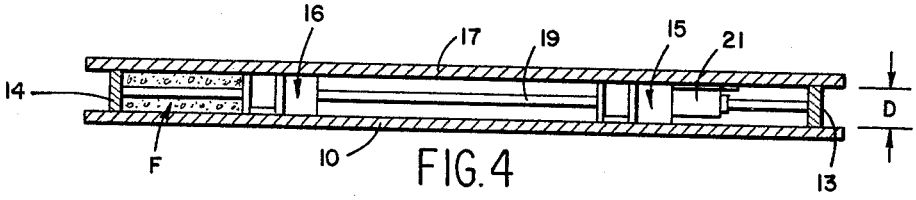
FIG. 4 is a cross section taken in the direction of the arrows 4—4 of FIG. 3 of the completely assembled components.

FIG. 4 shows the assembly from an edge cross sectional view and it will be noted that top and bottom edges of the inserts are in engagement with the opposing wall surfaces of the panels 17 and 10 respectively, thus providing reinforcement against any inward buckling. In addition, the foam designated in both FIGS. 3 and 4 at F after setting provides further reinforcement as well as desired soundproofing and fire resistant characteristics.

Since the inserts are relatively small as is evident from FIGS. 3 and 4, the overall prefabricated panel is potentially lighter than presently available panels which normally have wooden studs extending from one side to the other of the structure.

Figure 5:
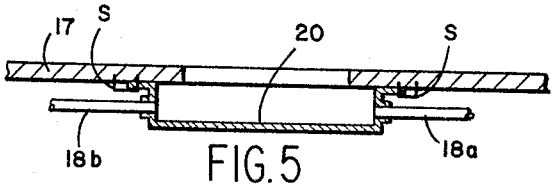
FIG. 5 is a fragmentary cross section taken in the direction of the arrows 5—5 of FIG. 4.

FIG. 5 shows in greater detail the utility box 20 secured to the underside of the panel 17 as by truss staples S. Panel 17 is provided with a pre-cut opening 20' providing access to box 20. the utility conduits 18*a* and 18*b* are secured to opposite sides of the box 20 after panel 17 is in position and before panel 10 is positioned to cover the bottom of the frame.

The foregoing arrangement provides two distinct advantages: first, cutting of utility openings in the wall panel in the field is eliminated. Second, the conduits 18*a* and 18*b* are stabilized by the box against bending or dislocation by expanding foam when the foam is introduced.

In the wall assembly described in FIGS. 1–5, the length dimension set forth is approximately twice the width dimension, the overall dimensions of each prefabricated wall assembly being approximately four feet by eight feet. The overall thickness for the panels in position would be approximately five inches.

Figure 6:
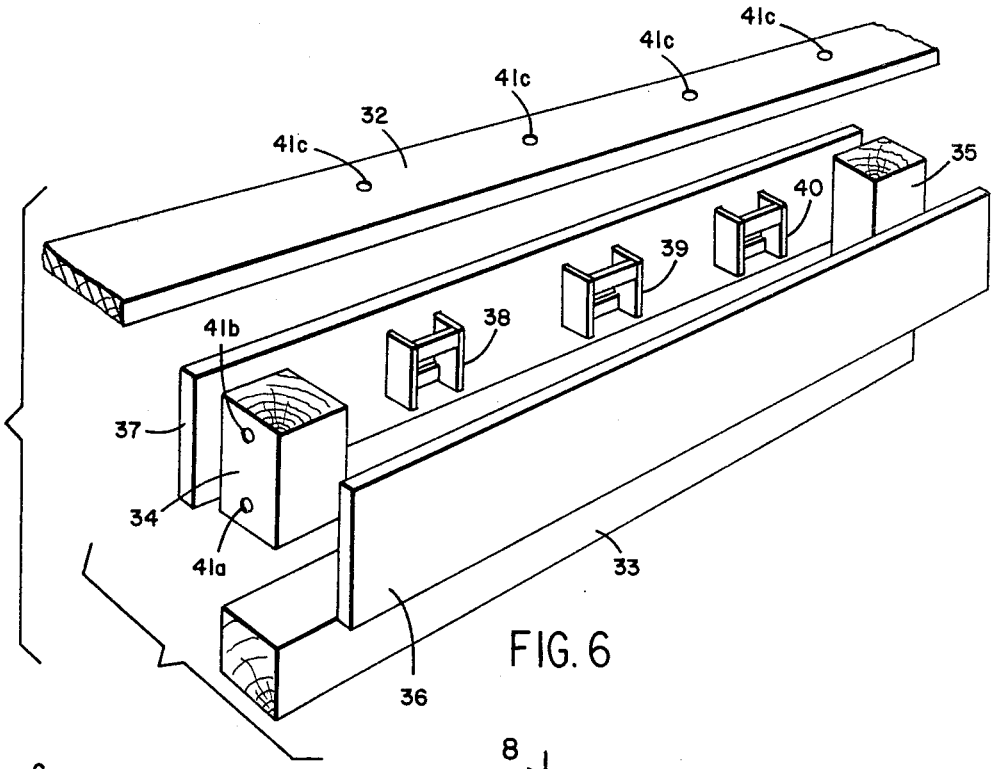
FIG. 6 is an exploded perspective view illustrating a panel construction in accord with this invention to be used as an overhead beam.

Referring now to FIG. 6, there is illustrated a prefabricated assembly useful as an overhead beam in a doorway or large entry in a building or residential construction. Again there is provided essentially a rectangular frame, this frame being made up of an overhead board 32, header beam 33 and shorter sides formed by wooden blocks 34 and 35. First and second panels 36 and 37 in the shape of elongated rectangles are arranged to be secured to opposite sides of the rectangular frame structure formed by the member 32, 33, 34 and 35 when assembled.

In the construction of FIG. 5, there are provided three inserts 38, 39 and 40, each of these inserts being identical to the insert 15 described in FIG. 2. A foam entrance opening 41*a* is provided in the lower end of the block 34 with a primary exit opening 41*b* and the upper portion of this block. Secondary exit openings 41*c* are provided in overhead board 32 as indicated.

Figure 7:
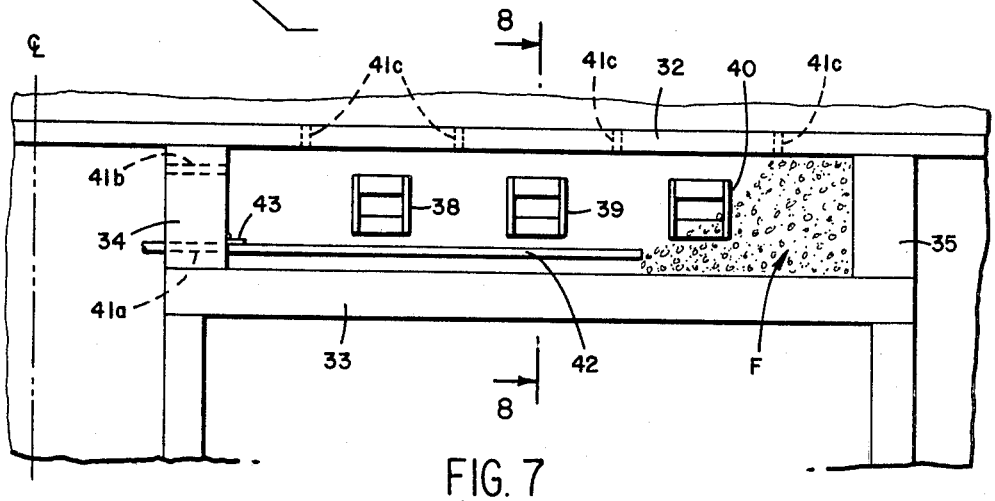
FIG. 7 is a front cross section of the components of FIG. 6 in assembled relationship.

Referring to FIG. 7, it will be noted that a foam tube 42 is introduced through the opening 41*a* to eject foam as it is withdrawn to the left. This foam will flow along the bottom of the enclosed rectangular area and upwardly through the through passages of the inserts 38, 39 and 40, air escaping out the exit openings 41*b* and 41*c*.

After the foam tube 42 is completely withdrawn, an appropriate plug can be inserted in the opening 41*a*. Alternatively, a flap like valve member such as indicated at 43 may be provided on the inside of the opening such that it will collapse after the tube is withdrawn under the foam pressure and thus seal the opening 41*a*.

Figure 8:
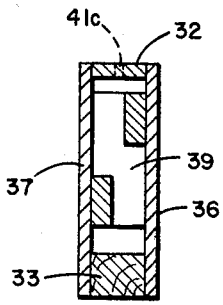
FIG. 8 is a cross section taken in the direction of the arrows 8—8 of FIG. 7.

In the cross section of FIG. 8, it will be noted that the inserts such as the insert 39 has its opposite edge surfaces in full surface engagement with the central portions of the panels 36 and 37 thereby providing the desired reinforcement, there again being provided through passages so that all of the voids in the inserts as well as within the rectangular area are filled.

While the panels 10 and 17 of the wall structure described in FIGS. 1 through 5 and the overhead beam 32 and panels 36 and 37 in the embodiments of FIGS. 6 through 8 may be wood, it should be understood that such panels can be of any continuous or scarf-joined structural material.

In addition, the truss staples S described in the various embodiments for securing certain components together are preferably of the type described and claimed in my copending patent application Ser. No. 938,377 filed Aug. 31, 1978 and entitled TRUSS STAPLE.

From all of the foregoing, it will be evident that the present invention has provided a greatly improved prefabricated wall assembly which is light, easy-to-manufacture, and yet possesses the necessary strength and durability characteristics desirable for prefabricated walls.

I claim:

1. A pre-fabricated wall assembly including, in combination:

(a) a first rectangular panel member;

(b) a rectangular frame of given length, width and depth dimensions, said first panel member being secured to one side of said rectangular frame;

(c) at least one reinforcing insert having a depth dimension equal to said given depth dimension positioned in said rectangular frame;

(d) a second rectangular panel secured to the opposite side of said rectangular frame so that said rectangular frame and insert are sandwiched between said first and second panels; and (e) foam material filling the voids within said rectangular frame and insert between the opposing wall surfaces of said first and seond panels, said insert comprising two parallel long sides and two parallel short sides extending between the adjacent ends of the long sides to define essentially a square frame, one of the shorter sides extending between lower portions of first ends of the longer sides to also engage the inner wall of said first panel, and the other shorter side extending between upper portions of the second ends of the longer sides to engage the inner wall of said second panel, there being open spaces above and below the one and other shorter sides respectively for permitting said foam to pass through and fill the insert.

2. An assembly according to claim 1, having a foam inlet opening communicating with the interior of said frame and at least one exit opening from the interior of said frame such that foam introduced into said entrance opening will completely fill the interior of said frame, air escaping out said exit opening.

3. An assembly according to claim 2, in which said rectangular frame is spaced slightly inwardly of the peripheral edges of said first and second panels, said length dimension being approximately twice said width dimension, and wherein there is provided an additional insert of depth the same as said given depth dimension positioned within said rectangular frame, said first mentioned and additional inserts being at distances respectively of approximately one fourth said given length dimension from the shorter sides of said rectangular frame.

4. An assembly according to claim 3, in which said first and additional inserts have their long sides both oriented at angles with respect to the longitudinal axis of the longer sides of said rectangular frame, said foam being introduced by a tube passed through said entrance opening to a far corner portion of said frame towards which shorter sides of the rectangular inserts are oriented so that a smooth flow path for the foam ejected from the end of the tube through the inserts is realized, said exit opening being adjacent to the diagonally opposite corner of said rectangular frame.

5. An assembly according to claim 2, in which the longer sides of said frame constitute an overhead board and header beam respectively, the shorter sides of the frame comprising blocks vertically disposed between said overhead board and header beam to define said frame, there being provided two additional inserts to said one insert, the total of three inserts being evenly spaced between the shorter sides of the rectangular frame and said foam entrance opening being located to communicate with a lower central portion of the interior of said rectangular frame, and said exit opening being located to communicate with an upper central interior portion of said frame whereby after foam has been introduced, there results an integral overhead structure for use in doorways and similar openings.

6. An assembly according to claim 2, in which said second rectangular panel includes pre-cut openings with utility boxes secured under the openings; and utility conduits extending between the shorter sides of said rectangular frame into opposite sides of the utility boxes, said boxes holding said conduits against bending appreciably when foam is introduced into said rectangular frame between the panels.

* * * * *